United States Patent [19]

Van Blunk

[11] 4,312,398

[45] Jan. 26, 1982

[54] METHOD OF FORMING FIBER AND METAL COMPOSITE STRUCTURES

[75] Inventor: Joseph J. Van Blunk, Glenolden, Pa.

[73] Assignee: The Boeing Company, Seattle, Wash.

[21] Appl. No.: 79,880

[22] Filed: Sep. 28, 1979

[51] Int. Cl.[3] ..... B22D 19/14

[52] U.S. Cl. ..... 164/108; 164/34; 164/112

[58] Field of Search ..... 164/97, 108, 112, 45, 164/33, 34

[56] References Cited

U.S. PATENT DOCUMENTS 4,053,011 10/1977 Riewald et al. ..... 164/97

FOREIGN PATENT DOCUMENTS 1508939 9/1969 Fed. Rep. of Germany ..... 164/97
1949777 10/1970 Fed. Rep. of Germany ..... 164/97
576161 10/1977 U.S.S.R. ..... 164/108

*Primary Examiner*—Gus T. Hampilos

*Attorney, Agent, or Firm*—Robert S. Lipton; Jack D. Puffer

[57] ABSTRACT

A method of forming ceramic fiber and metal composite structures is disclosed. The method is particularly useful in forming such structures having a complex shape. Fibers are coated with an investment grade sticky wax as a fugitive organic binder. Aluminium oxide coated with a sticky wax binder have been found to have greater flexibility than the fibers alone or fibers coated with other binders. The coated fibers are then laid up into a preform of the desired shape. The preform is elevated to a moderate temperature prior to pressure compaction. The preform may be combined with other preforms to form a more complex shape. The preform is then installed in a casting mold and elevated to a temperature sufficient to remove the sticky wax binder. Molten metal is then introduced into the mold where it fills the voids created by the removal of the sticky wax. Subsequent to cooling, the fiber and metal composite material is removed from the casting mold.

16 Claims, 14 Drawing Figures

METHOD OF FORMING FIBER AND METAL COMPOSITE STRUCTURES

BACKGROUND OF THE INVENTION

1. Field of the Invention

This invention relates generally, to a method of forming fiber and metal composite structures. In particular, the invention relates to forming composite structures from aluminium oxide fibers and magnesium.

2. Description of the Prior Art

Composite materials are generally well known. There are currently in use many composite materials made of various fibers and resins. Fiberglass and boron filament resin composite structures, for example, are in widespread use.

Efforts have been underway for many years to produce composite structures by combining high strength fibers or filaments in a metal matrix. Such efforts have met with some success. However, forming such parts by the method of casting has been difficult. Problems have been encountered in achieving a good bond between the fiber and metal matrix.

A fiber of polycrystalline aluminium oxide has been found to result in an excellent bond with magnesium and aluminium. This fiber was developed by the DuPont Company and is marketed under DuPont's trademark Fiber FP. Such fibers are generally coated with a fugitive organic binder. Fiber FP has been coated with such a binder, Rhoplex. Rhoplex is a trademark of the DuPont Company.

The coated fibers are laid up into a preform. The preform is then heated and compressed. The preform is then placed in a casting mold where the temperature is again elevated so as to permit the binder to either drain or burn off. The voids thus created are then filled by molten metal.

Fiber FP coated with Rhoplex preforms must be subjected to approximately 3,000 pounds per square inch in the compaction step. This requires complex and expensive tooling. Additionally, Fiber FP coated with Rhoplex is extremely brittle resulting in a high fiber failure rate when laying up curved preforms. Additional fibers are broken during compaction. It is difficult to combine preforms of Fiber FP coated with Rhoplex to form more complex structures, prior to their insertion into the casting mold due to Rhoplex's lack of adhesionary characteristics.

SUMMARY OF THE INVENTION

A primary object of the present invention is to provide a method of forming fiber and metal composite structures.

Another object of the present invention is to provide a method of forming polycrystalline aluminium oxide fiber and magnesium composite structures.

Still another object of the present invention is to provide a method of forming curved composite structures made from polycrystalline aluminium oxide fibers.

Still another object of the present invention is to provide a method of forming polycrystalline aluminium oxide fiber preforms which require low compaction pressures.

Still another object of the present invention is to provide polycrystalline aluminium oxide fiber preforms which can easily be combined with other preforms to create more complex structures prior to their insertion into casting molds.

A further object of the present invention is to provide a fugitive organic binder material which when coated on high strength fiber materials in general and polycrystalline aluminium oxide fibers in particular, will result in a combination which has greater flexibility than such fibers in combination with other binders or such fibers alone permitting them to be bent into curved shapes.

A further object of the present invention is to provide a fugitive organic binder material for high modulus fibers which, when laid up into preforms, requires low compaction pressures.

Still a further object of the present invention is to provide a fugitive organic binder material for high strength fibers which possesses satisfactory adhesionary characteristics which will enable preforms to be combined prior to casting.

The present invention is the discovery that investment sticky wax functions in a dramatic manner as a fugitive organic binder for high strength fibers.

Other objects, features and advantages of the present invention will be apparent from the description which follows, taken together with the accompanying drawings in which like numerals refer to like parts.

DESCRIPTION OF THE PREFERRED EMBODIMENT

Figure 1:
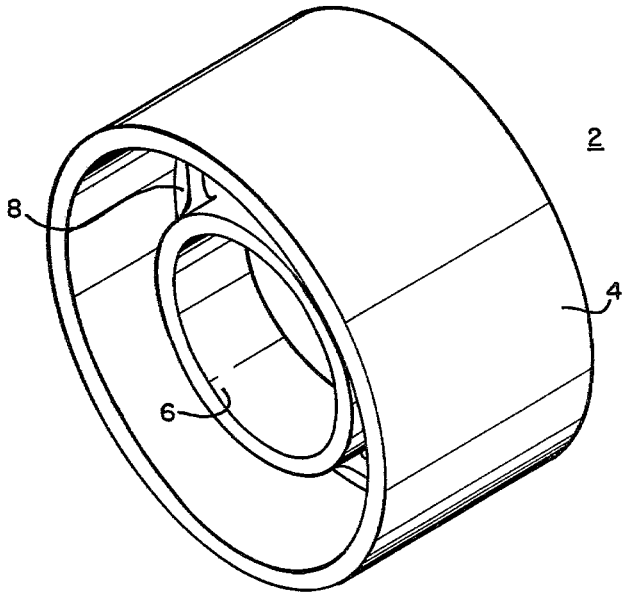
FIG. 1 shows a structure which may be made in accordance with the present invention.

A housing 2 for a gear utilized in helicopter transmissions is shown in FIG. 1. The housing 2 is representative of the type of complex structure which may be manufactured from a fiber and metal composite material using the present invention. The housing 2 includes an outer cylinder 4 connected to an inner cylinder 6 by webs 8. Each of the components of the housing 2 may be preformed and cast separately and then combined, or combined as preforms with reinforcement and then cast as a single structure.

The manufacture of cylinder 4 as an end component will now be described with reference to FIGS. 2 through 13.

Figure 2:
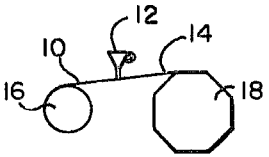
FIG. 2 schematically shows investment grade wax being applied to a sheet of fibers.

As shown in FIG. 2, fibers 10 are coated with an investment grade sticky wax 12 resulting in coated fibers 14. The uncoated fibers 10 are unrolled from a spool 16 onto a drum winder 18, in the form of a sheet.

Any investment grade sticky wax may be used in the present invention, but it has been found that Ceita wax manufactured by M. Argueso & Co., Inc. of Mamaroneck, N.Y. is suitable for the present invention.

Figure 3:
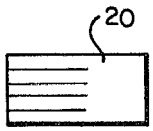
FIG. 3 shows the fibers being split into sheets.

As is shown in FIG. 3 the coated fibers are split into sheets 20 of the desired size. Depending upon the type of part or component being formed, various size sheets and filaments may be used. In the present invention Fiber FP fibers were used having a diameter of 20 microns.

Figure 4:
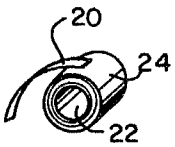
FIG. 4 shows the sheets being laid up on a male form.

As shown in FIG. 4, sheets 20 are laid up on a male form 22 to form preform 24.

Figure 5:
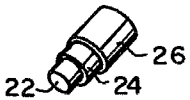
FIG. 5 shows the male form being removed from the interior of a preform.
Figure 6:
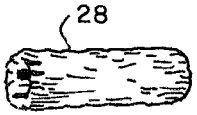
FIG. 6 shows the preform being compressed by a vacuum bag.

As is shown in FIG. 5 the male form 22 is removed from the interior of the preform 24. A steel casting mold or shell 26 is placed about the preform 24. The preform 24 and casting shell 26 is then encompassed by a vacuum bag 28, as shown in FIG. 6.

Figure 7:
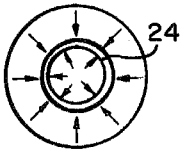
FIG. 7 shows a vacuum being applied to the bag.
Figure 8:
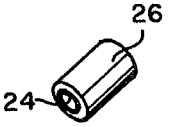
FIG. 8 shows the vacuum bag removed.

As is shown in FIG. 7 vacuum is then applied to the bag, which is then installed in an autoclave, not shown, so as to apply a pressure of 100 pounds per square inch to the preform 24 in the preferred embodiment of the invention. It has been found that, pressures of less than 150 pounds per square inch are obtainable with the present invention. While the preform is being subjected to the pressure it is heated to approximately 180° F. The pressure is applied so as to compact the fibers and binder. The compaction is aided by the addition of heat. Subsequent to compaction, the vacuum bag is removed, as shown in FIG. 8.

Figure 9:
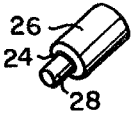
FIG. 9 shows a casting shells being installed in the interior of the preform.

As is shown in FIG. 9 an inner steel casting shell 28 is then installed in the interior of the preform 24. The gap between the inner and outer steel casting shells 28 and 26 is then sealed by welding or other suitable means. An orifice permitting access to the preform 24 is created at the opposite ends of preform 24.

Figure 10:
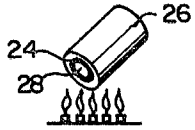
FIG. 10 shows the preform being heated to remove the wax.

As is shown in FIG. 10 the preform and casting shells 26 and 28 are heated to approximately 1,200° F. This causes the investment grade sticky wax to burn leaving practically no residue, in a manner similar to that used in the "lost wax" method of investment casting.

Figure 11:
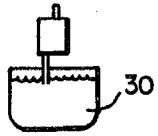
FIG. 11 shows molten metal being drawn to fill the voids left by the wax.
Figure 12:
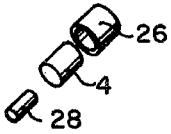
FIG. 12 shows the casting shells being removed.
Figure 13:
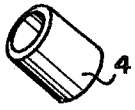
FIG. 13 shows the resultant composite structure.

Molten metal is then caused to infiltrate the voids left by the burning of the wax. As is shown in FIG. 11 a vacuum has been used in the present invention to draw molten metal 30, magnesium in the preferred embodiment, into the voids. Subsequent to cooling as is shown in FIG. 12, the inner and outer steel casting shells 28 and 26 are removed from the cylinder which resulted from the preform 24. As is shown in FIG. 13 the cylinder 4 is a composite structure of high strength Fiber FP fibers and magnesium.

The inner cylinder 6 and webs 8 may be formed in a similar manner and then welded together to form the housing 2, which is shown in FIG. 1.

The use of investment grade sticky wax as the binder significantly increases the degree of flexibility of the coated fibers 14. Experience has shown that such fibers can be wrapped around circular preforms having a diameter as small as 0.25 inches without causing structural failure of the fibers 10. Other known binder coated fibers have been shown to undergo structural failure when wrapped around circular preform molds having a diameter as small as 10.0 inches and this required an additional step of soaking the binder coated fibers in solvents which reduced their stiffness.

Other known binders, currently in use, require pressures as great as 3,000 PSI during the compaction step shown in FIG. 7. This has required the use of more complex and expensive compacting equipment and preform molds.

The flexibility and adhesionary characteristics of coated fibers 14 utilizing investment grade sticky wax enables complex parts, such as housing 2, to be cast as a single unit during the step showed in FIG. 11. This is accomplished by laying up each of the components of the complex structure as separate preforms 24, then assembling them in their preform state and inserting the resultant combination of preforms in a casting shell or shells. The assembly or combining of the various preforms would occur between the steps shown in FIGS. 8 and 9.

Figure 14:
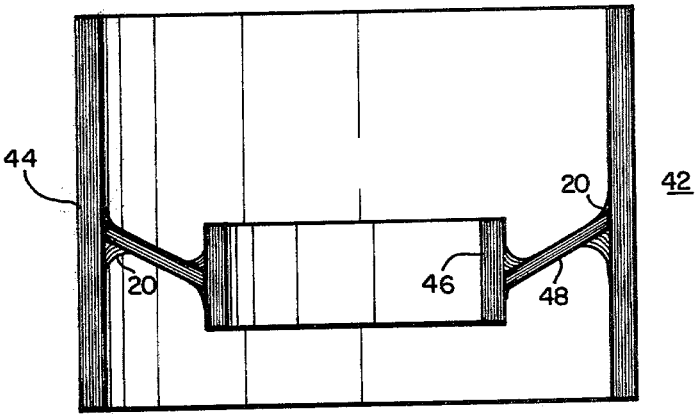
FIG. 14 shows the preform of the structure shown in FIG. 1.

The step of assembling the preforms required to manufacture housing 2 is shown in FIG. 14, where the cross-section of the assembled preforms is shown. Assembly 42, when cast, will result in the housing 2. The preform 44 for the outer cylinder 4 is shown connected to preform 46 for the inner cylinder 6 by preforms 48 for the webs 8. The components literally stick to one another due to the adhesionary characteristics of the investment grade sticky wax binder 12. Of course, each of the preforms 44, 46, and 48 are formed using the method similar to that shown in FIGS. 2 through 8, although the configuration and type of preforms and use of casting shells will vary according to the particular component and end product being manufactured.

In order to provide fiber continuity between the various components of the end product, additional fibers may be added by applying sheets 20 of binder coated filaments 14 at the juncture of the various preforms. This is done so that the final structure, housing 2 in this case, will have the additional strength which will result from such fiber continuity between components.

Subsequent to the assembly of the various preforms manufacture is completed in a manner similar to that shown in FIGS. 9 through 13.

As may be understood by those skilled in the art from the foregoing description and drawings, the present invention represents a significant advance over the prior art. While the invention has been illustrated and disclosed with reference to a particular embodiment, it is to be understood that various changes and modifications may be made without departing from the spirit of the invention.

What is claimed is:

1. The method of forming a composite structure from a fiber material and a second material which comprises:

coating the fiber material with an investment grade wax;

then bending the coated fiber material into a preform, said bending being performed to bend the fibers to a degree greater than that which would cause fracture of the fiber material if not coated with said investment grade wax;

then removing the investment grade wax binder; and then infiltrating the voids created by removing the wax from the fiber material with the second material.

2. The method of claim 1 which includes compacting the preform.

3. The method of claim 1 which includes heating the preform so that it is at an elevated temperature during said compacting.

4. The method of claim 2 which includes combining at least a pair of preforms prior to said removing of the binder.

5. The method of forming ceramic fiber and metal composite structure which comprises:

coating the fibers with an investent grade wax binding;

then bending the coated fibers into a preform, said bending being preformed to bend the fibers to a degree greater than that which would cause fracture of the fiber material if not coated with said investment grade wax;

then infiltrating the voids created by the removing of said wax with molten metal; and cooling the molten metal.

6. The method of claim 5 which includes compacting the preform.

7. The method of claim 6 wherein said preform is compacted by a pressure less then 150 pounds per square inch.

8. The method of claim 7 which includes heating the preform so that it is at an elevated temperature during said compacting.

9. The method of claim 8 wherein said preform is heated to a temperature of approximately 180° F.

10. The method of claims 5, 6, 7, 8, or 9 wherein the ceramic fiber is a polycrystalline aluminium oxide fiber.

11. The method of claim 10 wherein the metal is magnesium.

12. The method of claim 10 wherein the metal is aluminium.

13. The method of claims 5, 6, 7, 8, or 9 which includes combining at least a pair of preforms prior to said removing of the binder.

14. The method of claim 13 wherein the ceramic fiber is a polycrystalline aluminium oxide fiber.

15. The method of claim 14 wherein the metal is magnesium.

16. The method of claim 14 wherein the metal is aluminium.

* * * * *

UNITED STATES PATENT AND TRADEMARK OFFICE

CERTIFICATE OF CORRECTION

PATENT NO. : 4,312,398

DATED : January 26, 1982

INVENTOR(S) : Joseph J. Van Blunk

It is certified that error appears in the above-identified patent and that said Letters Patent are hereby corrected as shown below:

--Claim 5, line 3, delete the word "investent" and insert in its stead the correct spelling investment.

--Claim 5, lines 3 and 4, delete the word "binding" and insert in its stead the correct word binder.

Signed and Sealed this

*Twenty-third* Day of *November 1982*

[SEAL]

*Attest:*

GERALD J. MOSSINGHOFF

*Attesting Officer*

*Commissioner of Patents and Trademarks*